US005847370A

United States Patent [19]

Sluka et al.

[11] Patent Number: 5,847,370

[45] Date of Patent: Dec. 8, 1998

[54] CAN COATING AND CURING SYSTEM HAVING FOCUSED INDUCTION HEATER USING THIN LAMINATION CORES

[75] Inventors: David L. Sluka, Milpitas; Hassan Iravani, San Jose; Robert A. Sprenger, deceased, late of Felton, all of Calif., by Barbara Sprenger, legal representative

[73] Assignee: Nordson Corporation, Westlake, Ohio

[21] Appl. No.: 425,995

[22] Filed: Apr. 20, 1995

Related U.S. Application Data

[63] Continuation-in-part of Ser. No. 532,945, Jun. 4, 1990, abandoned, and a continuation-in-part of Ser. No. 621,231, Nov. 30, 1990, abandoned.

[51] Int. Cl.[6] ..... H05B 6/10

[52] U.S. Cl. ..... 219/635; 219/604; 219/612; 219/676

[58] Field of Search ..... 219/604, 607, 219/610, 614, 635, 647, 650, 653, 660, 661, 672, 674, 612, 676

[56] References Cited

U.S. PATENT DOCUMENTS

| | | | |
|---|---|---|---|
| 2,489,867 | 11/1949 | D'Orio | 254/80 |
| 3,449,539 | 6/1969 | Scheffler | 219/10.69 |
| 3,523,602 | 8/1970 | Mojden et al. | 198/41 |

(List continued on next page.)

FOREIGN PATENT DOCUMENTS

| | | |
|---|---|---|
| 0 067 235 | 12/1982 | European Pat. Off. . |
| 0 120 810 | 3/1984 | European Pat. Off. . |
| 0 509 374 A1 | 10/1992 | European Pat. Off. . |
| 56030048 | 3/1981 | Japan . |
| 2111815 | 4/1990 | Japan . |
| 93/24242 | 12/1993 | WIPO . |

OTHER PUBLICATIONS

Akherraz, M. and Taj, E., "Medium Frequency Self Controlled Converter for Induction Heating Applications", Melecon '89 Proceedings, pp. 43–46 (1989).

Hassell, Peter A., "Medium Frequency Induction Melting—Its Control and Effective Operation", *Industrial Heating* (Mar. 1982), pp. 18, 20–21.

James, P.A., "General considerations for the choice of medium frequency for induction melting", elektrowarme international 41 (1983) B3 Jun., pp. B 138–B 146.

Lowdon, Eric, "Practical Transformer Design Handbook", 2nd Edition, (1989), pp.85–245, 266–302.

(List continued on next page.)

*Primary Examiner*—Tu B. Hoang
*Attorney, Agent, or Firm*—Fliesler, Dubb, Meyer & Lovejoy

[57] ABSTRACT

The side seam of a can is coated and heated inductively by passing it through a medium frequency, oscillating magnetic field generated by an induction coil wound around a core. The core is shaped and oriented so as to have two magnetically opposite poles direct magnetic flux in a concentrated manner from the coil into the side seams of cans traveling along a path of travel. The cores are constructed using individual laminations of high frequency core material, each less than about 0.006 inches thick, individually insulated from each other and bound together to form a U- or E-shaped core directing flux toward the workpiece. The induction coil is constructed using a form of Litz wire and the coil and core are air-cooled. In one embodiment, the core has a plurality of pole pieces each directed toward the path of travel. The induction coil is wound on the core such that sequential ones of the pole pieces along the path of travel have alternatingly magnetically opposite polarities. In one embodiment, the inductive heating apparatus is used as a pre-curing stage, downstream of a side seam inside coat applicator and upstream of a curing oven, but located in close enough proximity to the side seam inside coat applicator to heat the coating sufficiently to bind it in place so that it does not fall off the seam and onto the conveyor before it reaches the curing oven.

27 Claims, 5 Drawing Sheets

U.S. PATENT DOCUMENTS

| | | | |
|---|---|---|---|
| 3,526,027 | 9/1970 | Manuel et al. | 29/200 |
| 3,694,609 | 9/1972 | Kennedy | 219/10.79 |
| 3,727,982 | 4/1973 | Itoh et al. | 299/14 |
| 3,790,735 | 2/1974 | Peters, Jr. | 219/10.49 |
| 3,794,802 | 2/1974 | Mohr | 219/10 |
| 3,830,353 | 8/1974 | Mojden | 198/20 R |
| 3,840,138 | 10/1974 | Mohr | 219/10.57 |
| 3,961,150 | 6/1976 | Lewis et al. | 219/10.49 |
| 3,966,426 | 6/1976 | McCoy et al. | 29/196.2 |
| 4,017,704 | 4/1977 | Collins, III et al. | 219/10.79 |
| 4,160,891 | 7/1979 | Scheffler | 219/10.69 |
| 4,268,737 | 5/1981 | Paschakarnis et al. | 219/10.49 |
| 4,272,313 | 6/1981 | Mori et al. . | |
| 4,296,294 | 10/1981 | Beckert et al. | 219/10.41 |
| 4,307,276 | 12/1981 | Kurata et al. | 219/10.41 |
| 4,315,568 | 2/1982 | Mojden | 198/690 |
| 4,323,150 | 4/1982 | Mojden | 198/690 |
| 4,333,246 | 6/1982 | Sullivan et al. | 34/23 |
| 4,339,645 | 7/1982 | Miller | 219/10.49 R |
| 4,351,430 | 9/1982 | Mojden | 198/690 |
| 4,364,466 | 12/1982 | Mojden | 198/459 |
| 4,481,397 | 11/1984 | Maurice et al. | 219/10.61 R |
| 4,482,879 | 11/1984 | Jackowicz | 336/55 |
| 4,490,922 | 1/1985 | Gorodetsky et al. | 34/1 |
| 4,531,037 | 7/1985 | Camus | 219/10.75 |
| 4,539,456 | 9/1985 | Mohr | 219/10.69 |
| 4,582,972 | 4/1986 | Curtin et al. | 219/10.69 |
| 4,595,607 | 6/1986 | Betteridge et al. | 427/185 |
| 4,596,913 | 6/1986 | Takechi et al. | 219/8 |
| 4,673,781 | 6/1987 | Nuns et al. | 219/10.49 R |
| 4,708,325 | 11/1987 | Georges | 266/90 |
| 4,749,593 | 6/1988 | Weiss | 427/180 |
| 4,754,113 | 6/1988 | Mohr et al. | 219/10.79 |
| 4,759,946 | 7/1988 | Ribnitz | 427/8 |
| 4,775,772 | 10/1988 | Chaboseau | 219/10.61 R |
| 4,783,233 | 11/1988 | Yasumuro et al. | 156/227 |
| 4,810,843 | 3/1989 | Wicker et al. | 219/10.43 |
| 4,846,774 | 7/1989 | Bell | 493/87 |
| 4,849,598 | 7/1989 | Nozaki et al. | 219/10.41 |
| 5,101,086 | 3/1992 | Dion et al. | 219/10 |
| 5,313,037 | 5/1994 | Hansen et al. | 219/632 |
| 5,321,896 | 6/1994 | Brownewell et al. | 34/247 |
| 5,325,601 | 7/1994 | Brownewell et al. | 34/247 |
| 5,483,042 | 1/1996 | Sprenger et al. | 219/647 |
| 5,529,703 | 6/1996 | Sprenger et al. | 219/604 |

OTHER PUBLICATIONS

Mohan, Ned, et al., "Power Electronics: Converters, Applications, and Design", John Wiley & Sons (no date), pp. 75–79.

Moskowitz, Lester R., "Permanent Magnet Design and Application Handbook", Robert E. Krieger Publishing Company (1986), pp. 242,252–253.

Pillar Industries, "Mark 12 Transistorized Solid State Power Supply—10kHz through 80kHz Output Frequency", Datasheet (Jun. 3, 1990).

Schaufler, K., "Stationary and Mobile Medium–Frequency Plant for Induction Heating", *Brown Boveri Review* (Feb. 1978), vol. 65, pp. 88–95.

Sears, Roebuck and Co., "Kenmore Induction Cooktop—Use & Care Manual" (Jul. 1985).

Smith, T., "Atomic energy technology applied in liquid metal processing", *Metallurgia* (Apr. 1990), vol. 57, No. 4, p. 174.

W. R. Grace, "Can End Preheat Systems", Brochure (no date).

Zinn, Stanley and Semiatin, S. L., "Coil design and fabrication: basic design and modifications", *Heat Treating,* (Jun. 1988), pp. 32–36.

Zinn, Stanley and Semiatin, S. L., "Coil design and fabrication: part 2, specialty coils", *Heat Treating,* (Aug. 1988), pp. 29–32.

Zinn, Stanley and Semiatin, S. L., "Coil design and fabrication: part 3, fabrication principles", *Heat Treating,* (Oct. 1988), pp. 39–41.

Zinn, Stanley and Semiatin, S. L., "Elements of Induction Heating—Design, Control, and Applications", Electric Power Research Institute, Inc. and ASM International, (1988), pp. 1–8, 47–75, 85–141, 185–226.

FIG. I
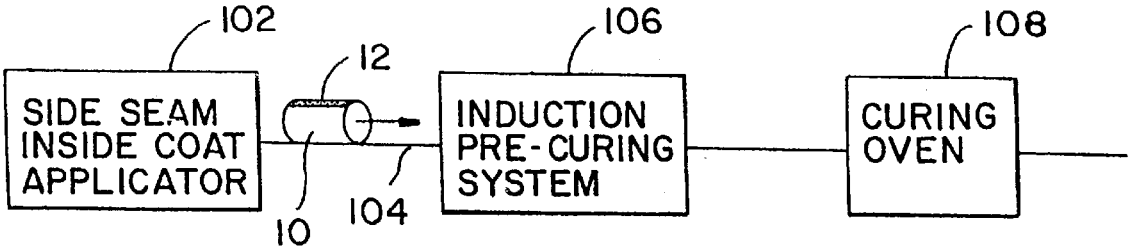
FIG. II
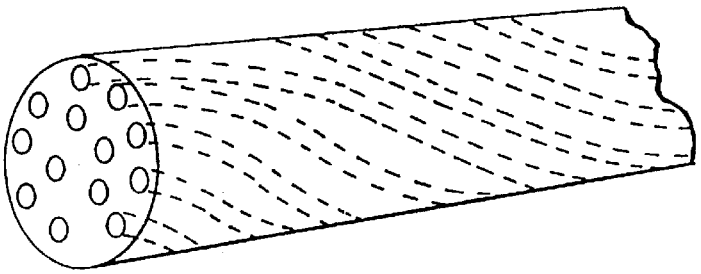

CAN COATING AND CURING SYSTEM HAVING FOCUSED INDUCTION HEATER USING THIN LAMINATION CORES

CROSS-REFERENCE TO RELATED APPLICATIONS

This is a continuation-in-part of U.S. patent application Ser. No. 07/532,945, filed Jun. 4, 1990, entitled INDUCTION DRYER, by inventor Robert A. Sprenger, now abandoned.

This is also a continuation-in-part of U.S. patent application Ser. No. 07/621,231, filed Nov. 30, 1990, entitled INDUCTION DRYER, by inventors Robert A. Sprenger and Douglas F. Shepherd, now abandoned.

Both of the above parent applications satisfy the co-pendency requirements of 35 U.S.C. §120 by virtue of the co-pendency of U.S. patent application Ser. No. 08/295,083, filed Aug. 24, 1994, which is a continuation of U.S. patent application Ser. No. 07/832,987, filed Feb. 10, 1992, now abandoned, which is a continuation-in-part of U.S. patent application Ser. No. 07/621,231, filed Nov. 30, 1990, now abandoned, which is a continuation-in-part of U.S. patent application Ser. No. 07/532,945, filed Jun. 4, 1990, now abandoned.

This application is also related to U.S. patent application Ser. No. 07/832,987, filed Feb. 10, 1992, entitled INDUCTION DRYER AND MAGNETIC SEPARATOR, by inventors Robert A. Sprenger and Douglas F. Shepherd, now abandoned.

The above applications (Ser. Nos. 07/532,945; 07/621,231; 07/832,987) are all assigned to the assignee of the present application, and are incorporated herein by reference in their entirety.

BACKGROUND

1. Field of the Invention

The present invention relates to a method and apparatus for inductively heating metal objects, and more particularly, to a method and apparatus for inductively heating the side seams of cans for curing and other purposes.

2. Description of Related Art

During the manufacturer of certain kinds of metal cans, a section of sheet metal, cut to size, is curled into a cylinder. The joint between the two now-contacting edges of the sheet metal is welded, creating a weld seam or side seam. The inside surface of the sheet metal comes pre-coated from the manufacturer, but the welding process burns off the coating in the vicinity of the side seam. An inside side seam coat must therefore be reapplied after the welding process, in order to protect the contents of the can from the weld metal.

Manuel U.S. Pat. No. 3,526,027, incorporated herein by reference, teaches that a strip of powder coating material can be applied to the inside weld seam, and the narrow seam area can be heated to cause the powder to fuse and cure. The patent suggests that either strip gas burners or RF or HF induction coils can be used for this purpose, but does not identify any structure for such coils. Other, similarly nonspecific, teachings of induction heating of can side seams for different applications are set forth in Yasumuro U.S. Pat. No. 4,783,233 (1988) and Ribnitz U.S. Pat. No. 4,759,946 (1988), both incorporated herein by reference. See also PCT Publication No. WO 93/24242 (9 Dec. 1993) and Mohr U.S. Pat. No. 3,794,802, also both incorporated herein by reference.

Heating of can side seams by magnetic induction is difficult, however, in part because of the sheet metal construction of the cans. Induction heating at high frequencies creates problems of non-uniform heating, in which various portions of the sheet metal workpiece are heated to greatly varying temperatures depending on proximity to the coil and other factors. Consequently, localized overheating can easily occur, even before other parts of the side seam are heated to a desired temperature.

Another problem with conventional inductive heating techniques is that, especially at higher frequencies, high current densities along the outside surfaces of the work coil conductors and along the outside surfaces of conductors leading to and from the work coil cause excessive heating and necessitate water cooling. Typically, in fact, these conductors are constructed using copper tubing with water flowing through the center. Water cooling systems can be expensive and bulky, and can substantially increase the cost, size and maintenance needed for the inductive heating system.

In Yasumuro U.S. Pat. No. 4,783,233, incorporated above, the side seam is inductively heated by a single-turn heating coil. Such a coil may cause problems in a can manufacturing production line, since it may induce unwanted heating currents in magnetic side guides of the workpiece conveyance system. But narrower coils, shaped and sized to minimize currents induced into the conveyance apparatus, may not be able to focus sufficient energy into the workpiece quickly enough. This problem is exacerbated when the coil constitutes a copper pipe, which is thick and difficult to confine to narrow areas.

The heating of other types of metal objects by high-frequency induction is taught in, for example, U.S. Pat. No. 4,339,645 to Miller; U.S. Pat. No. 4,481,397 to Maurice; U.S. Pat. No. 4,296,294 to Beckert; U.S. Pat. No. 4,849,598 to Nozaki; U.S. Pat. No. 5,313,037 to Hansen; and U.S. Pat. No. 5,101,086 to Dion; all incorporated by reference herein. While some of the systems disclosed in these references may be usable for heating can side seams, they are not optimal. In particular, for example, they may be very large and bulky, may require water cooling, they may be inefficient due to unnecessary wasting of flux energy, and they may not be adaptable to concentrating flux energy in sufficiently narrow regions of a workpiece such as a can side seam.

SUMMARY OF THE INVENTION

Accordingly, it is an object of the present invention to provide can side seam heating apparatus which overcomes some or all of the above disadvantages.

According to the invention, roughly stated, the side seam of a can is heated inductively by passing it through a medium frequency, oscillating magnetic field generated by a non-liquid cooled induction coil wound on a core. The core is shaped and oriented so as to have two magnetically opposite poles directing magnetic flux in a concentrated manner from the coil into the side seams of cans traveling along a path of travel.

The use of medium frequency (defined herein as 500 Hz to 50 kHz) induction heating is desirable in can and can end manufacturing, because the depth at which currents are induced in the workpiece renders the apparatus widely tolerant of varying can sizes and shapes and wall thickness (within limits), and a variety of different production line speeds. However, at such frequencies and at the needed power levels, standard solid ferrite cores would not work well. Such cores would build up eddy currents themselves, and the resulting heat could break them apart. On the other hand, it is difficult to use pancake or spiral coils to melt and cure the powder coating on a side seam, because of the desire to direct the heat into a very small space within a very short time.

It is known, in the field of transformers, to limit any current flow in a transformer core by constructing the core with a plurality of separately insulated, face-to-face laminations. See, for example, Lowdon, "Practical Transformer Design Handbook", 2nd ed. (TAB Books, 1989), incorporated herein by reference. Induction heating with laminated flux concentrations have also been used in steel tempering applications, although these are generally very high-temperature applications (the steel will glow red or white hot) such as tempering the surface of engine crank shafts and the teeth on gears. However, such laminated cores have not been used as described herein for induction heating to melt and cure the powder coating on a side seam. In accordance with an aspect of the invention, the induction heating cores are constructed using individual laminations of high frequency core material, each less than about 0.006 inches thick. In one embodiment, the laminates are between about 0.002 inches and about 0.006 inches thick. The laminations are individually insulated from each other and bound together to form a U- or E-shaped core directing flux toward the workpiece.

In an aspect of the invention, the induction coil, instead of being made of copper tubing, is instead constructed using a form of Litz wire and the coil is air-cooled rather than water cooled. Frequencies of up to about 20 kHz are used in a non-water-cooled environment.

In one embodiment, the core has a plurality of pole pieces each directed toward the path of travel of a series of cans being conveyed longitudinally through the apparatus. The induction coil is wound on the core such that sequential ones of the pole pieces along the path of travel have alternatingly magnetically opposite polarities.

The induction heating apparatus can be disposed in a can manufacturing line downstream of a side seam inside coat applicator, in order to cure the side seam coat. The induction heating apparatus can also be used to provide a temperature boost in assistance of a conventional (e.g., gas) oven which may disposed upstream or downstream of the inductive heating apparatus. In one embodiment, the inductive heating apparatus is used as a pre-curing stage, downstream of the side seam inside coat applicator and upstream of a curing oven, but located in close enough proximity to the side seam inside coat applicator to heat the coating sufficiently to set it in place so that it does not fall off the seam and onto the conveyor before it reaches the curing oven. Such a pre-cure provides at least two advantages. First, as line speeds have been increased and coatings changed over the years, existing ovens may be providing a marginal cure. Curing quality can be improved by preheating cans before (or post-heating cans after) an existing oven. Second, by setting powder coatings prior to further processing, cans need not be handled with as much care prior to entering the full cure oven. Again, faster line speeds are possible using existing ovens as the can has already been partially heated to desired temperature.

BRIEF DESCRIPTION OF THE DRAWINGS

The invention will be described with respect to particular embodiments thereof, and reference will be made to the drawings, in which:

FIG. 1 illustrates a portion of a can manufacturing production line;

FIG. 11 is a detail of part of the coil wire shown in FIGS. 5, 6 and 7;

DETAILED DESCRIPTION

Figure 2:
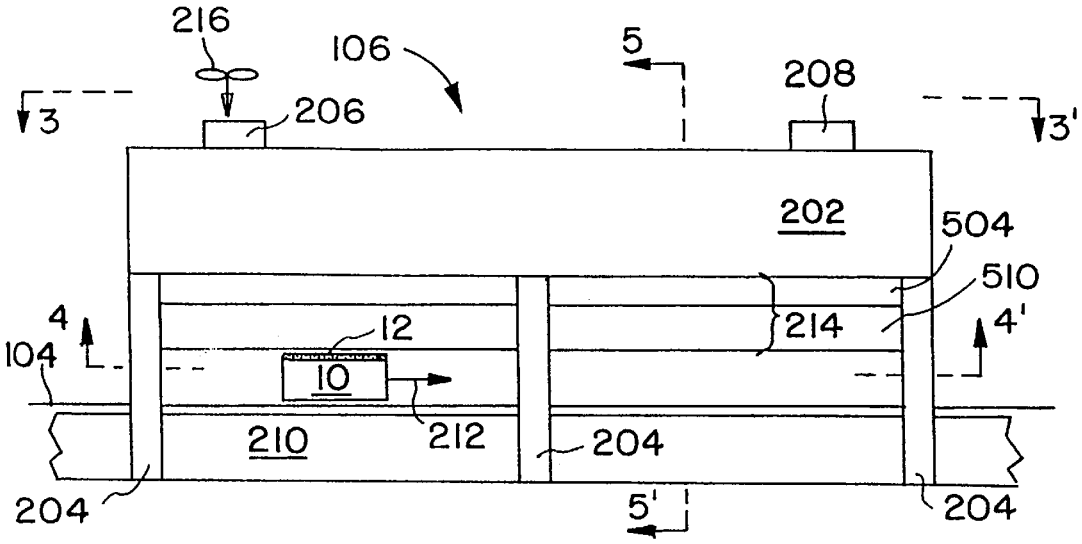
FIG. 2 is front view of the induction heating system in FIG. 1.

FIG. 1 illustrates a portion of a can manufacturing production line. Prior to the portion illustrated in FIG. 1, sheet metal can blanks are formed into a cylinder around a mandrel (not shown). In doing so, the edges of the blank are abutted together and welded. Can bodies so welded are carried into a side seam inside coat applicator 102 in which a liquid or powder coating material is applied to the inside of the can body along the side seam. In one embodiment, the coating material is a lacquer and heat is used to drive out solvents or water to cure or dry a lacquer coating on the inside of the side seam. In another embodiment, the coating material is a powder which, when heated, melts and cures to form a tough coating on the inside of the side seam. An example of a suitable inside coating applicator for can side seams is illustrated in Weiss U.S. Pat. No. 4,749,593, incorporated herein by reference.

Can bodies 10 emerge from the side seam inside coat applicator 102 being carried by a conveyor 104, and before any heat is applied to the coating material on the seam. Although only one can body 10 is shown in FIG. 1, it will be understood that in a continuous can manufacturing process, a plurality of cans emerge from the side seam inside coat applicator sequentially. These can bodies are oriented longitudinally (i.e., the central axis of the can body cylinder is substantially parallel to the direction of motion of the can body), and are abutting or nearly abutting each other end-to-end. The side seam, illustrated as 12 in FIG. 1, is oriented longitudinally on each can body 10, and is located inside the can on the top of the can body at the 12 o'clock position.

The conveyor 104 may be a conveyor belt, or any other transport mechanism such as a linear motor, chain conveyor, pusher, puller, gravity slide, and so on. The term "conveyor" as used herein also includes a combination of two or more conveyors in sequence.

The conveyor 104 carries the can body 10 from the side seam coat applicator into an induction heating system 106 which, in the production line illustrated in FIG. 1, operates as a pre-curing station. After the induction pre-curing system 106, the conveyor 104 carries the cans 10 into a curing oven 108 which may be a conventional gas oven. The conveyor 104 then carries the cans 10 on to further processing (not shown). As the terms are used herein, the side seam inside coat applicator 102 is considered to be disposed "upstream" of the induction pre-curing system 106, because the can bodies 10 flow from the side seam inside coat applicator 102 to the induction pre-curing system 106. Similarly, the curing oven 108 is considered to be "downstream" of the induction pre-curing system 106, since the cans flow from the induction pre-curing system 106, toward the curing oven 108.

In the case where the side seam inside coat applicator applies a powder to the inside side seam of can bodies 10, it is desirable to place the induction pre-curing system 106 in close proximity to the output of the side seam inside coat applicator 102. Otherwise, since the powder coating is held to the seam only electrostatically and to some extent by the heat of the weld, some of the powder particles will fall off the seam and onto the conveyor 104. Over time, this powder can build up and become a maintenance problem. The induction pre-curing system 10 can avoid this problem by being disposed in sufficient proximity to the side seam inside coat applicator 102 to partially cure the powder coat material before more than an insubstantial amount falls loose. For example, at a line speed of 80 meters per minute, the induction precuring system 106 can be placed within 1 foot of the powder sprayer in the side seam inside coat applicator 102.

In another embodiment, the side seam heater could be mounted upstream of the spray nozzle. This would allow the can to be heated hot enough so that the powder will become sticky enough on contact to stick to the can.

Whether or not the induction heating system 106 is used for such pre-curing purposes, it does provide a temperature increase in advance of the final curing oven 108. This relaxes the requirements on the curing oven 108, allowing it to be shorter in length or use reduced energy. For this purpose, the induction heating system 106 can be disposed either upstream or downstream of the curing oven 108 along the path of travel of the cans 10.

The induction heating system 106 can also be used as a full curing oven, if it is made long enough to raise the temperature of the side seams to a high enough temperature for a long enough period of time. For example, with an appropriate row of induction coils carrying an appropriate amount of current, a five-meter length of induction heater 106 can substitute for a 50-foot long conventional gas oven (at an appropriate line speed) to cure side seams.

Figure 3:
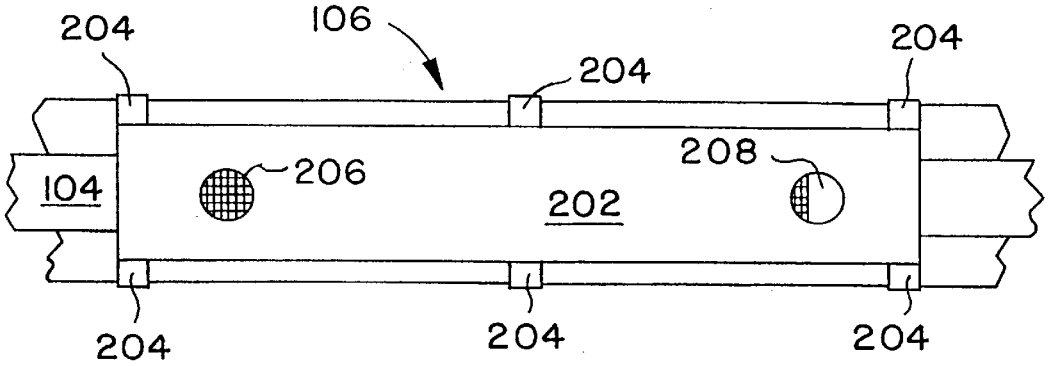
FIG. 3 is a top view taken along lines 3—3' of FIG. 2.
Figure 4:
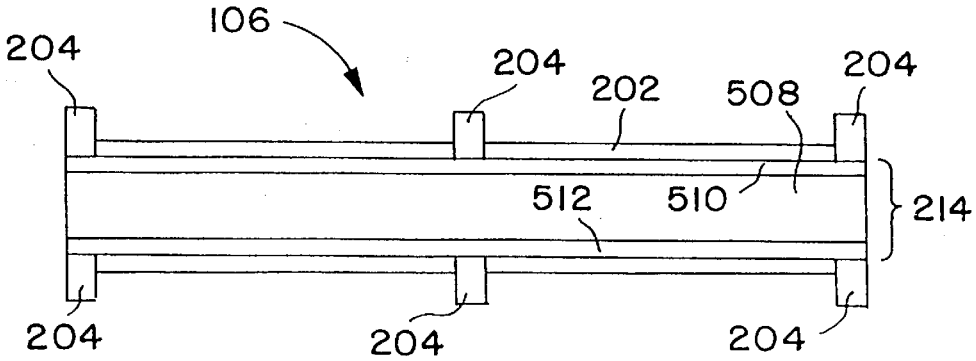
FIG. 4 is an underside view taken along lines 4—4' of FIG. 2.
Figure 5:
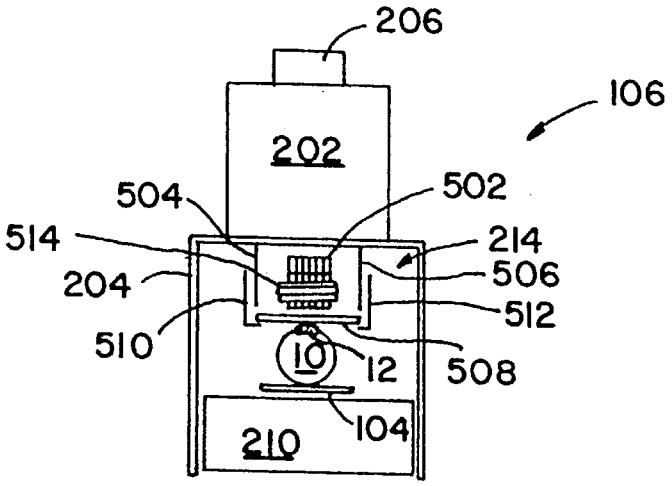
FIG. 5 is an end view, taken along lines 5—5' of FIG. 2.

FIG. 2 is a front view of an induction heating system 106 such as that which may be used in the production line of FIG. 1. FIG. 3 is a top view taken along lines 3—3'; FIG. 4 is an underside view taken along lines 4—4'; and FIG. 5 is an end view taken along lines 5—5' in FIG. 2. Referring to FIG. 2, the apparatus includes a box 202, which is held at a distance above the conveyor 104 by braces 204. The box 202 contains the capacitors (not shown) of the tank circuit for the induction heating coils; the capacitors should be as close as possible to the induction heating coils in order to minimize the length of high current capacity wires required.

On top of the box 202 is a forced air intake 206 at one end of the box 202, and a forced air outtake 208 at the other end of the box. Air is forced into the air intake 206 by a fan shown symbolically in FIG. 2 as 216. As can be seen in FIG. 3, for reasons which will become apparent below, the outtake 208 is mostly covered. Returning to FIG. 2, the conveyor 104 rides on a table 210, which conveys the cans 10 along the path of travel indicated by arrow 212. The cans are held onto the conveyor by permanent magnets located below the belt. Attached to the underside of the box 202 and hanging just above the side seams of the cans as they are conveyed through the apparatus, is an enclosure 214 containing a magnetic flux concentrator with induction coils would thereon.

The structure of the enclosure 214 is best seen in FIG. 5. As can be seen, the concentrator 502 is disposed longitudinally along most of the length of the induction heating unit 106, between two vertical walls 504 and 506 made of nonmagnetic and electrically nonconductive material. Below the concentrator 502 and also extending the length of the concentrator, is a thin, nonmagnetic and electrically nonconducting sheet 508 which may be made, for example, of 220° C.-rated fiberglass laminate. Two L-brackets 510 and 512 are attached to either side of the sheet 508. The structure formed by sheet 508 and L-brackets 510 and 512 is spaced slightly below the lower edges of walls 504 and 506 in order to provide a convection path for some of the cooling air from air intake 206. That is, some of the cooling air forced into intake 206 travels down into enclosure 214, where it circulates around the concentrator 502 and the induction heating coils 514 before exiting through the baffles formed by wall 504 and L-bracket 510 on one side and wall 506 and L-bracket 512 on the other side. It is not necessary that the apparatus described herein be liquid cooled.

Figure 12:
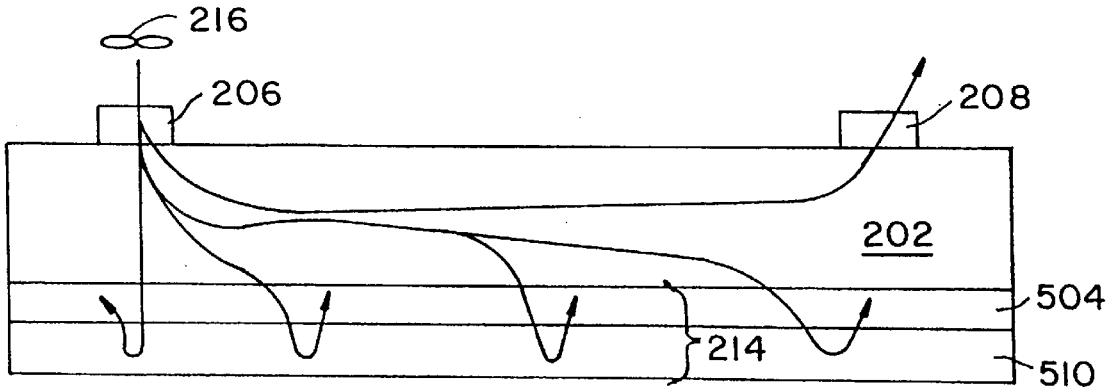
FIG. 12 is a front view of the induction heating system of FIG. 1 illustrating airflow.

The airflow through the apparatus is shown generally in FIG. 12. As can be seen, air enters the inlet 206. Some of the air remains entirely within the box 202, traversing its length and exiting through the outlet 208. This airflow helps to cool the capacitors in the box 202. The partial covering on the outlet 208 (see FIG. 3) restricts part of the airflow exiting through the outlet 208, however, forcing some of the air to flow down into the enclosure 214. The air flows between the posts of the concentrator 502, cooling the cores as well as the coils. In another embodiment, air could be forced longitudinally along the concentrator from one end to the other, but this would reduce the cooling efficiency toward the outlet end of the concentrator because the air has already been heated near the inlet end.

The enclosure 214, including the cover sheet 508, also provides operator protection from the medium frequency oscillating currents in the coil 514. The cover sheet 508 is kept thin in order to minimize the gap between the lower surfaces of concentrator 502 and the can side seams 12. In one embodiment, this gap is only 2–7 millimeters in height. However, such a cover sheet is not essential to the successful operation of the system. Note that in an induction heating system such as 106, the gap can intentionally be made wider in parts of the path of travel and narrower at other parts of the path of travel in order to reduce or increase, respectively, magnetic flux coupling into the can side seam at different points along the path of travel.

Figure 6:
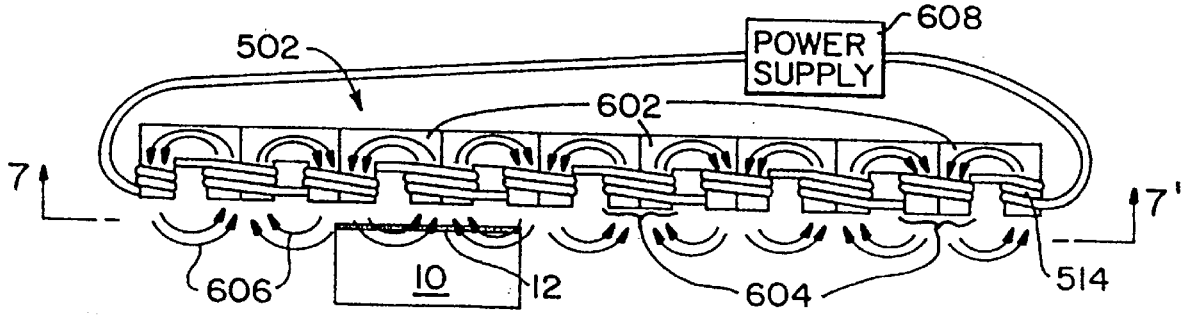
FIG. 6 is a front view, partially symbolic, of the magnetic flux concentrator and induction coil in FIG. 5.
Figure 7:
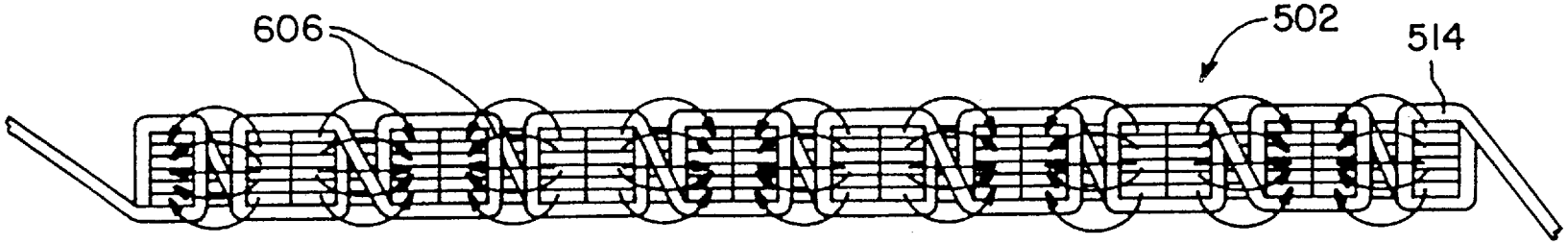
FIG. 7 is an underside view of the apparatus of FIG. 6, taken along lines 7—7' of FIG. 6.

FIG. 6 is a front view, partially symbolic, of the magnetic flux concentrator 502 and induction coil 514 in FIG. 5. FIG. 7 is an underside view of the apparatus of FIG. 6, taken along lines 7—7' of FIG. 6. Referring to FIG. 6, it can be seen that the magnetic flux concentrator 502 comprises a plurality of U-shaped cores 602, disposed in end-to-end relationship to form a row extending longitudinally along the path of travel of the cans 10. In another embodiment, the concentrator can be made of E-shaped cores placed end-to-end in the same manner. In yet another embodiment, the concentrator can be a one-piece unit. Because two or more cores placed end-to-end (and wound to accomplish the purposes described herein) function in the same manner as a single core having the same overall shape, the term "core" as used herein can be made of several parts, each of which are also referred to herein as "cores".

Figure 10:
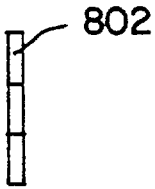
FIG. 10 is an underside view, taken along lines 10—10' of the laminate of FIG. 8.
Figure 9:
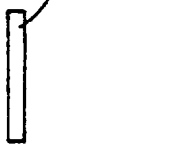
FIG. 9 is an end view, taken along lines 9—9' of the laminate of FIG. 8.
Figure 8:
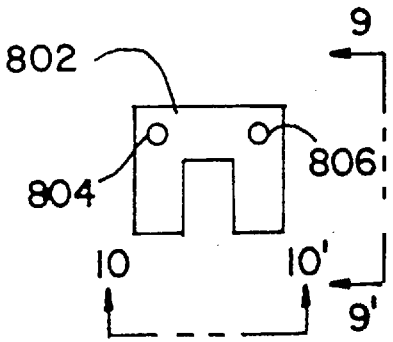
FIG. 8 is one view of a laminate used in the cores of FIGS. 6 and 7.

Each of the U-shaped cores 602 is constructed using a plurality of individually electrically insulated laminates 802, one of which is illustrated in FIG. 8. An end view, taken along lines 9—9' of FIG. 8 is shown in FIG. 9, and an underside view, taken along lines 10—10' of FIG. 8, is illustrated in FIG. 10. Unlike the relatively thick laminates that are used to form 60 Hz transformer cores, the laminates 802 are extremely thin, preferably less than 0.006 inches thick (in a dimension normal to the page in FIG. 8). To inhibit circulating currents and self-heating, the thinner the laminates 802, the better. However, due to practical limitations imposed by commercial availability of off-the-shelf laminates, a thickness range of about 0.002 to about 0.006 inches is preferred. The laminates are preferably made of grain-oriented silicon steel, with the grain oriented to conduct magnetic flux lines best within the plane of the laminate (the plane of the page in FIG. 8). However, other kinds of materials may be used instead, such as nickel-iron alloy. In one embodiment, these laminates can be made from Part Number DU37, available from Magnetic Metals Corporation, Camden, N.J. Such laminates are made for use normally in high frequency transformers, and are supplied in a U-shape having longer legs than those shown in the drawings. They also are intended to have another piece mounted across the open ends of the laminate after coils are wound on the posts, in order to complete the flux loop. However, the part is modified for use in the present embodiment by discarding the latter piece and by shortening the posts of the U-shape somewhat in order to achieve the shapes illustrated in FIGS. 8, 9 and 10. The laminates are pre-coated with an electrically insulating coating.

Referring again to FIG. 6, the laminates 802 are supplied with an electrically insulating coating. A large number of these laminates, on the order of 200 of them, are affixed adjacent to each other in face-to-face manner to form a core having a width of approximately one inch (measured in a dimension normal to the page in FIG. 6). This is sufficient width to handle a large variety of different kinds of cans 10, even those with relatively wide side seams. The laminates can be bound together by threaded stainless steel rods through holes 804 and 806 in the laminates (see FIG. 8).

The U-shaped laminated cores are placed end-adjacent to each other in a row as shown in FIG. 6 to form the magnetic flux concentrator 502. They are wound with coil wire 514 in alternatingly opposite directions, in order to polarize alternating ones of the pole pieces 604 with opposite magnetic poles. (Alternatively, only alternating ones of the pole pieces 604 can receive coil windings, all of which are wound in the same direction). This creates magnetic flux loops which, for a given direction of current flow through the coil windings, flow in a direction out of every other pole piece and into each of the intervening pole pieces. The magnetic flux flow for a given current direction is shown as arrows 606 in FIGS. 6 and 7. The power supply 608 is an alternating current supply, so the magnetic flux lines 606 reverse their direction at the frequency of the power supply 608.

It can be seen in FIG. 6 that the magnetic flux lines 606 pass through the wall of can bodies 10, in a manner which is concentrated in and around the side seam 12. The magnetic flux lines 606 are referred to herein as being substantially longitudinal because, for the most part, they are directed longitudinally to the longitudinal dimension of the can 10. As illustrated in FIG. 7, the flux lines 606 are not exactly parallel to the central axis of the can 10, because of the bowing effect on the flux lines which results from the finite width of the cores 602. Nevertheless, they are considered herein to be substantially longitudinal.

Figure 13:
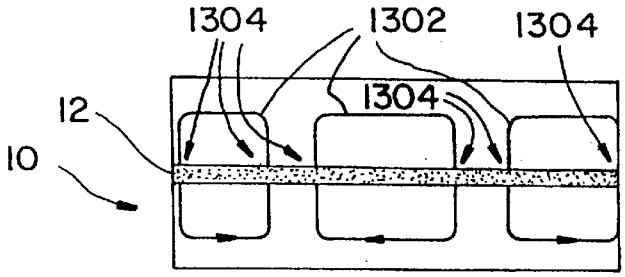
FIG. 13 is a top view of a can illustrating eddy current flow.

FIG. 13 is a top view of the can body 10, lying on its side, with the side seam 12 at the 12 o'clock position. Current loops 1302 illustrate symbolically the current loops which are induced in the can body 10 as it passes under the coils and flux concentrator 502. It is well known that eddy currents induced in the workpiece substantially mirror the shape of the coil windings. Thus, because the coils are shaped as a number of relatively small current loops under which the can passes longitudinally, the eddy currents induced in the can body 10 follow a similarly shaped, but oppositely directed path as indicated in FIG. 13.

It can be seen that induction heating of the side seam is accomplished primarily in heating zones 1304, where eddy currents travel across the side seam 12. These crosswise heating zones are several in number at the same time. Although some heating of the side seam results by conduction from the heating effect of eddy currents in longitudinal portions of the eddy current loops 1302, and some heating of the side seam 12 results from eddy currents in the can body 10 which mirror currents in the portions of the coil wire which carry current from one pole piece of the concentrator to the next, the great majority of the heating of the side seam 12 is due to eddy currents which cross the side seam in regions 1304. These crosswise heating regions sweep longitudinally along the length of the can body 10 as the can is transported longitudinally under the concentrator 502. Moreover, since the concentrator 502 is lengthy compared to the length of the can 10, the side seam 12 will experience many such sweeps of heating bands as the can traverses the length of the concentrator. This makes for even heating which is effective to melt or dry a coating.

The coils 514 are wound using a type of wire bundle which is similar to Litz wire. Specifically, a large number of individually lacquered (electrically insulated) thin wire strands are twisted together (for example, 100) to form a first twisted bundle. For example, 100 strands of 30 AWG wire form the first twisted bundle. Such a first bundle is illustrated in FIG. 11. By using a large number of individually insulated strands as opposed to one heavier wire or copper tube, the wire diameter of an individual strand will be small compared to its skin depth. Thus the wire itself will not be heated inductively to any great extent. In addition, much greater current density is achievable at medium frequencies because the well-known skin effect no longer can force the current flow into the outer circumference of the bundle. By achieving greater current density at medium frequency, the overall thickness of the winding wire can be made thinner, thereby permitting a larger number of turns in a smaller space. A larger number of turns induces a heavier eddy current flow in the workpiece for a given overall current flow in the coil windings, and the ability to pack those turns into a smaller space means they can be disposed closer to the workpiece and thereby improve coupling.

Several of these first bundles, four for example, are twisted together again to form the wire bundle illustrated in FIGS. 5, 6 and 7. Unlike standard Litz wire, however, the wire used in the present embodiment twists the four first bundles together in the same twist direction as the direction in which the individually insulated strands are twisted together to form the first bundle. This forgoes some of the current density advantage of standard Litz wire, but it makes for a tighter bundle. Such a tighter bundle can then be wound more tightly and perhaps with more turns, around the pole pieces of the cores 602. However, standard Litz wire can also work well.

As shown in FIG. 6, the coils are wrapped around the pole pieces of the concentrator 502 at approximately two and one-half turns per pole piece. The windings are physically spaced from the cores by a bobbin, in order to prevent any scraping from compromising the electrical insulation of the coil wire. The bobbin is electrically nonconductive and should be resistant to temperatures up to about 220° C.

The power supply 608 is an alternating current power supply with current outputs that are connected to opposite ends of the coil wire 514. The frequency of current oscillation is essentially the same as the resonant frequency of the coils in combination with the tank capacitors in the box 202 (FIG. 2), which is on the order of 8 kHz. Other frequencies, such as 15 kHz, can also be used if appropriate tank capacitors are used. In general, a range of frequencies between about 3 kHz and about 20 kHz is preferred given the can side seam wall thickness on the order of about 0.01 inches. Frequencies as low as 800 Hz would also work, assuming appropriate capacitors can be found or made. In general, medium frequencies (about 500 Hz to about 50 kHz) permit deep heating and a wide tolerance of workpiece dimensional changes and types of conductive material while focusing on heating a narrow region of the workpiece. Preferably, when the power supply 608 is first activated, it automatically but conventionally determines the frequency which optimizes power transfer into the workpiece given the tank capacitance and inductance.

The current output of the power supply 608 should be relatively continuous with low harmonic content. Low harmonic content reduces the skin effect for the lead wires to the tank capacitors and coils, thereby permitting the use of smaller wire leads. Also, the tank capacitors should be as close as possible to the coils themselves. The power supply circuit 608 does not need to adapt itself to different kinds and dimensions of cans 10, or side seams 12, because the cores 602 are wide enough to cover the side seams of a wide variety of different kinds of cans.

Finally, it is desirable that the power supply 608 output be continuously adjustable during activation and de-activation, rather than adjustable merely by a low-frequency duty cycle. This is because duty cycle pulses can cause the cans to vibrate and thereby undesirably shake loose some of the inside side seam powder coat. Accordingly, activation and de-activation of the power supply 608 is accomplished either by gradually increasing or decreasing (respectively) the DC voltage to the power supply 608, or by gradually changing the oscillation frequency toward or away from (respectively) the resonant frequency of the tank circuit. As yet another alternative, activation and deactivation of the power supply 608 can be accomplished by pulse-width-modulating a constant amplitude voltage supplied to the tank circuit, operating at the resonant frequency of the tank circuit. The narrower the pulse width, the more of its energy will be located in the higher frequency harmonics and the less in the fundamental at the tank resonant frequency. Since the tank circuit does not respond to the higher frequency harmonics, activation can be accomplished by gradually widening the pulses until most or all of the energy is located in the fundamental, and deactivation can be accomplished by gradually narrowing the pulses to reduce the proportion of energy that is located at the fundamental frequency.

An inductive heating system as described above can be used to pre-cure, post-cure or cure side seam inside coats of can bodies, in production lines ranging in speeds from 40 meters per minute or less up to 1200 meters per minute or more. Such different line speeds can be accommodated by adjusting the gap distance between the concentrator 602 and the cans, the power levels of the power supply 608, the number of turns of the induction coil, the frequency of flux reversals, and the length of the unit along the path of travel of the cans, among other factors.

Accordingly, a very compact, narrow and focused induction heating system has been described. The longitudinal placement of induction focusing cores focuses energy directly where needed, in the side seam of can body workpieces. Thus, less energy is needed than would be needed with less-focused coils. Conductive parts of the apparatus can also be nearer the coil while avoiding excessive heating. The forgiving advantages of medium frequency induction heating are maintained while focusing energy into the side seam. Very high metal temperature deltas can be achieved in a very small time period (for example, a delta of at least 80° C. in one second).

The foregoing description of preferred embodiments of the present invention has been provided for the purposes of illustration and description. It is not intended to be exhaustive or to limit the invention to the precise forms disclosed. Obviously, many modifications and variations will be apparent to practitioners skilled in this art. For example, frequencies which vary within the permitted range are possible. The embodiments were chosen and described in order to best explain the principles of the invention and its practical application, thereby enabling others skilled in the art to understand the invention for various embodiments and with various modifications as are suited to the particular use contemplated. It is intended that the scope of the invention be defined by the following claims and their equivalents.

We claim:

1. Apparatus for inductively heating an electrically conductive region of a workpiece, comprising:

an oscillating current source;

a non-liquid cooled induction coil coupled to carry said current output of said current source; and a core passing axially through said induction coil, said core being disposed and oriented to pass oscillating magnetic flux lines through said conductive region of said workpiece, said core including a plurality of face-to-face adjacent plate-like laminations, each insulated electrically from its face-to-face adjacent laminations, and each less than or equal to about 0.006 inches thick.

2. Apparatus according to claim 1, wherein said induction coil comprises a plurality of individually insulated electrically conductive strands, twisted together.

3. Apparatus according to claim 2, wherein said plurality of electrically conductive strands are twisted together in a first twist direction to form a first bundle, and wherein said induction coil comprises a plurality of said first bundles twisted together in said first twist direction.

4. Apparatus according to claim 1, wherein said core has first and second opposite polar portions, both said first and second opposite polar portions being directed toward said conductive region of said workpiece.

5. Apparatus according to claim 4, wherein said core is U-shaped with two parallel arms, said first and second polar portions being ends of said two parallel arms.

6. Apparatus according to claim 5, wherein said coil is wrapped around both of said parallel arms in opposite directions.

7. Apparatus according to claim 1, wherein said current source oscillates between about 3 kHz and about 20 kHz.

8. Apparatus according to claim 1, wherein said current source oscillates between about 800 Hz and about 20 kHz.

9. Apparatus according to claim 1, wherein said workpiece comprises a can and said conductive region of said workpiece comprises a side seam of said can, further comprising:

a conveyor conveying said can along a path of travel, such that said side seam passes through said oscillating magnetic flux lines.

10. Apparatus according to claim 9, wherein said core is disposed outside said path of travel and has first and second opposite polar portions, both directed toward said path of travel.

11. Apparatus according to claim 9, wherein said conveyor conveys said can in a longitudinal orientation along said path of travel, and wherein said core is oriented to pass said oscillating magnetic flux lines through said side seam substantially longitudinally.

12. Apparatus according to claim 11, wherein said core is U-shaped with two parallel arms being opposite polar portions, both directed toward said path of travel, and wherein said core is oriented longitudinally with said path of travel.

13. Apparatus according to claim 9, further comprising a side-seam inside coat applicator disposed along said path of travel upstream of said core.

14. Apparatus according to claim 13, further comprising a curing oven disposed along said path of travel downstream of said side-seam inside coat applicator.

15. Apparatus according to claim 14, wherein said curing oven is disposed downstream of said core, said core being disposed in close proximity to said side-seam inside coat applicator along said path of travel.

16. Can side seam heating apparatus comprising:

a conveyor conveying a can along a path of travel, said can having a longitudinally oriented side seam;

a magnetic flux concentrator having a plurality of pole pieces each directed toward said path of travel, said pole pieces being disposed in a row along said path of travel; and an induction coil for carrying an oscillating current, said induction coil being wound on said concentrator such that sequential ones of said pole pieces along said path of travel have alternatingly magnetically opposite polarities, and such that a plurality of said sequential pole pieces simultaneously induce a plurality of eddy current loops in said can and crossing said side seam.

17. Apparatus according to claim 16, wherein said induction coil comprises a plurality of individually insulated electrically conductive strands twisted together, and said induction coil is non-liquid cooled, further comprising a current source connected to provide said oscillating current, said current oscillating between about 3 kHz and about 20 kHz.

18. Apparatus according to claim 17, further comprising a side seam inside coating applicator disposed along said path of travel upstream of, but in close proximity with, said magnetic flux concentrator.

19. Apparatus according to claim 17, further comprising said can.

20. A system for coating and curing a coating on a side seam of a can; the can being formed from a blank by a can-forming machine into a cylinder, with the abutting edges of the blank being welded to form a side seam inside the cylinder, the side seam inside the cylinder being said side seam of the can, comprising:

an applicator for applying a coating to said side seam of the can;

an induction heating device disposed proximate to said applicator to heat said side seam of said can, said induction heating device including a work coil that is non-liquid cooled;

a conveyor for transporting said can from said applicator through said induction heating device; and an air-cooling system, said air-cooling system removing heat from said induction heating device.

21. The system of claim 20 wherein said conveyor transports said can along a path of travel through said induction heating device and wherein said induction heating device includes:

a magnetic flux concentrator having a plurality of pole pieces each directed toward said path of travel, said pole pieces being disposed in a row along said path of travel;

a current source having an oscillating current output; and an induction coil coupled to carry said current output of said current source and being wound on said concentrator such that sequential ones of said pole pieces along said path of travel have alternatingly magnetically opposite polarities.

22. The system of claim 21 wherein said air-cooling system includes an enclosure surrounding at least a part of said induction coil, and wherein air is circulated through said enclosure to remove heat from said coil.

23. The system of claim 22 wherein a curing oven is disposed downstream of said induction heating device to apply additional heat to said coated side seam.

24. Apparatus according to claim 1, wherein said oscillating current source oscillates at between about 500 Hz and about 50 kHz.

25. Apparatus for inductively heating an electrically conductive region of a workpiece, comprising:

a path of travel along which said workpiece is being moved;

a non-liquid cooled induction coil; and a source of electrical current oscillating between approximately 800 Hz and approximately 20 kHz, said source being coupled to pass said current through said induction coil, said induction coil being disposed and oriented relative to said path of travel so as to induce an oscillating current in said electrically conductive region of said workpiece as said workpiece is moved along said path of travel.

26. Apparatus according to claim 25, wherein said workpiece comprises a can and said electrically conductive region comprises a side seam on said can.

27. Apparatus according to claim 25, wherein said source of electrical current oscillates between approximately 3 kHz and approximately 20 kHz.

* * * * *